United States Patent [19]

Lichtenberger

[11] 4,180,715

[45] Dec. 25, 1979

[54] VITAL MOVABLE ELECTRICL CONTACT ARRANGEMENT

[75] Inventor: William J. Lichtenberger, Murrysville, Pa.

[73] Assignee: Westinghouse Air Brake Company, Swissvale, Pa.

[21] Appl. No.: 903,272

[22] Filed: May 5, 1978

[51] Int. Cl.[2] ..... H01H 1/24; H01H 1/26; H01H 1/28

[52] U.S. Cl. ..... 200/246; 200/263; 200/264; 200/265; 200/275

[58] Field of Search ..... 200/246, 263, 262, 265, 200/264, 283, 275, DIG. 42

[56] References Cited

U.S. PATENT DOCUMENTS

| | | | |
|---|---|---|---|
| 1,016,833 | 2/1912 | Larson | 200/275 |
| 1,665,550 | 4/1928 | Janette | 200/275 |
| 3,222,468 | 12/1965 | Nanninga | 200/275 X |
| 3,249,730 | 5/1966 | Felson | 200/275 X |
| 3,258,571 | 6/1966 | Schmidt, Jr. | 200/283 |
| 3,268,701 | 8/1966 | La Plante et al. | 200/275 |
| 3,340,372 | 9/1967 | Schaefer | 200/DIG. 42 |
| 3,562,466 | 2/1971 | McElligott | 200/264 |
| 3,790,733 | 2/1974 | Pohl | 200/283 |
| 4,092,157 | 5/1978 | Reid et al. | 200/265 X |
| 4,115,325 | 9/1978 | Santala et al. | 200/265 X |

FOREIGN PATENT DOCUMENTS

| | | | |
|---|---|---|---|
| 664901 | 9/1938 | Fed. Rep. of Germany | 200/262 |
| 2124707 | 8/1972 | Fed. Rep. of Germany | 200/262 |
| 2306825 | 8/1974 | Fed. Rep. of Germany | 200/262 |

*Primary Examiner*—Henry K. Artis

*Attorney, Agent, or Firm*—J. B. Sotak; R. W. McIntire, Jr.

[57] ABSTRACT

A fail-safe multiple transfer contact assembly including a plurality of front, back and heel contact elements. The contact elements include elongated leaf spring members which are fixed to a molded insulative contact block. A silver contact button is rivoted to the free ends of the front and back leaf spring members while a silver impregnated carbon contact block is soldered to the free end of the heel leaf spring member so that neither the front and back contacts cannot become welded to the heel contact.

11 Claims, 5 Drawing Figures

VITAL MOVABLE ELECTRICL CONTACT ARRANGEMENT

FIELD OF THE INVENTION

This invention relates to an improved vital electrical relay contact arrangement and more particularly to a novel non-weldable contact assembly employing a movable silver impregnated carbon element which is soldered to the end of a leaf spring member for selectively engaging the front and/or back silver contact points which are attached to the ends of elongated contact fingers.

BACKGROUND OF THE INVENTION

In vital equipment employing electromagnetic relays, it is common practice to utilize a non-weldable front contact point, such as, silver impregnated carbon element, to make an electrical connection to a silver contact point of a movable or heel contact leaf spring member. Thus, previous vital or fail-safe relays were susceptible to having their back and heel contacts welded by excessive high currents. However, this was not necessarily unsafe or fatal as long as precautionary measures were taken to prevent the closing of the front contact at the same time. That is, in a vital relay if a back contact and a heel contact should become frozen together, they must be so constructed as to ensure that a welded pair of contacts cannot make or touch a front contact while in a welded condition. In order to achieve such operation, efforts have been expended in the prior art and while successful, it has been customarily accomplished by mechanically arranging the contact structure to require the utmost precision in manufacturing and adjustment during assembly. The ever increasing or escalating costs have plagued the manufacturers of such vital electromagnetic relays. In order to reduce the overall costs and expense of manufacturing, it is highly advantageous to entirely eliminate the chance of welded contacts. Thus, it is extremely profitable to prevent the possibility of welding of the back and heel contacts as well as the front and heel contacts since the expense of extensive manufacturing and precision adjustments can be mitigated.

OBJECTS OF THE INVENTION

Accordingly, it is an object of this invention to provide an improved vital transfer switching arrangement.

A further object of this invention is to provide a new and improved fail-safe contact assembly for an electromagnetic relay.

An additional object of this invention is to provide a novel heel contact arrangement utilizing a silver impregnated carbon material for preventing the welding of front and back contacts.

Another object of this invention is to provide a unique electrical transfer contact assembly for a fail-safe relay.

Still a further object of this invention is to provide a fail-safe relay contact arrangement employing a silver impregnated carbon heel contact member for engaging silver front and back contact members.

Still another object of this invention is to provide a non-weldable electrical contact arrangement utilizing a heel contact having a silver impregnated carbon contact block soldered to the free end of an elongated leaf spring member for cooperating with front and back silver contact points.

Still an additional object of this invention is to provide a vital movable electrical contact having an elongated leaf spring member, the elongated leaf spring member having a terminal portion formed on one end and having a bifurcated portion formed on the other end, a non-weldable contact member having an elongated slot located on each side for accommodating the bifurcated portion, the contact member being fused to the bifurcated portion.

Yet a further object of this invention is to provide a new and improved silver impregnated carbon heel contact arrangement which is economical in cost, simple in construction, reliable in operation, efficient in service and durable in use.

SUMMARY OF THE INVENTION

In accordance with the present invention, there is provided a fail-safe electromagnetic relay contact arrangement including a plurality of movable heel contacts and a plurality of front and back contacts. The heel, front and back contacts are held in fixed spaced relationship to each other by a molded insulative contact block. Each of the contacts includes an elongated spring element formed of beryllium copper. One end of each of the beryllium copper spring contact elements is formed into a plug-in terminal portion while the other end of each of the front and back beryllium copper spring contact elements includes a silver contact point. The other end of the heel beryllium copper spring contact element is bifurcated to receive a silver impregnated carbon contact block. The silver impregnated carbon contact block is slotted on each side to accommodate the bifurcations. The contact block is undercut along each slot and is silver plated so that the contact block is soldered to the bifurcations. An insulative spacer card engages the tips of the front and back beryllium copper spring contact elements, and a movable insulative actuator engages the heel beryllium copper spring contact elements to cause the silver impregnated carbon contact blocks to open and close the respective front and back silver contact points without fear of contact welding and freeze-up.

DESCRIPTION OF THE DRAWINGS

The foregoing objects and other attendant features and advantages of the present invention will become apparent from the ensuing detailed description of the illustrative embodiment thereof, in the course of which reference is made to the accompanying drawings in which.

DETAILED DESCRIPTION OF THE INVENTION

Figure 1:
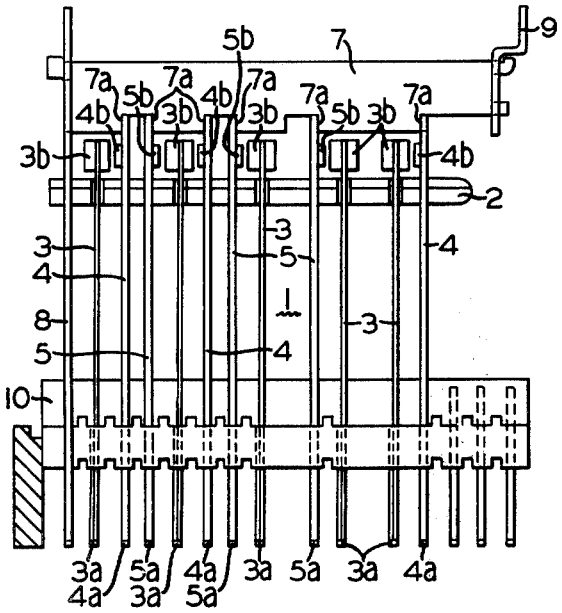
FIG. 1 is a side elevational view of the fail-safe electrical switching contact assembly for a vital electromagnetic relay in accordance with the subject invention.

Referring now to the drawings and in particular to FIG. 1, there is shown a multiple transfer or switching contact assembly generally characterized by numeral 1 for a vital type of electromagnetic structure and a pivotal armature which is attached to one end of a contact actuator or driver 2 of insulative material. In practice, the insulative actuator 2 takes the form of a ladder member which in turn acts upon all of the movable leaf spring contact elements 3 when the armature is operated. As shown, the free ends or tips of the front and back contact leaf spring elements 4 and 5 are held in spaced relationship by a spacer card 7 of insulative material. The insulative spacer 7 is held in position by a supporting spring 8 and a bracket member 9 which engage the respective ends of the card 7. The spacer card 7 includes steps or shoulder portions 7*a* which cooperate with the ends of the various fixed or stationary contacts 4 and 5.

As shown, the switching assembly or arrangement 1 includes a plurality of contact sets or stacks which are securely held in a molded insulative base or block 10. That is, the heel, front, and back contacts 3, 4, 5 and supporting spring 8 are disposed in juxtaposed relationship with each other in the molded block 10 so that male terminal engaging ends or portions 3*a*, 4*a* and 5*a* extend from the lower side as shown in FIG. 1. The male terminal portions are adapted to be plugged into suitable female connectors which are hard wired to various external electrical circuits.

Figure 2:
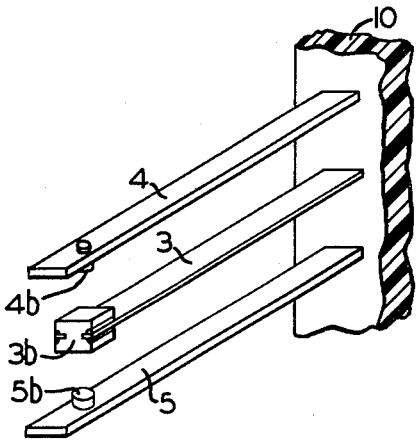
FIG. 2 is a partial slightly enlarged prospective view of a front, back and heel contact which are molded into an insulative relay switch block or base.

As shown in FIGS. 1 and 2, the free ends of the leaf springs are provided with contact engaging portions, such as, silver contact tips or buttons 4*b* and 5*b* or silver impregnated carbon blocks 3*b*, which are opened and closed to interrupt and establish the circuit paths to the external circuitry. In practice, the front and back silver buttons 4*b* and 5*b* are rivoted to the respective bottoms and tops of the elongated leaf springs 4 and 5. Each of the elongated leaf springs 3, 4, and 5 are preferrably made of suitable resilient metal, such as, beryllium copper, which has good mechanical and electrical qualities.

Figure 3:
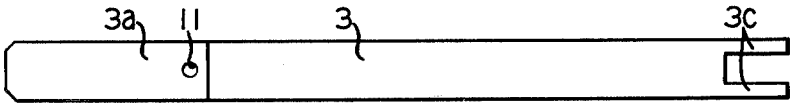
FIG. 3 is an enlarged top plan view of the contact leaf spring element of the movable heel contact.
Figure 4:
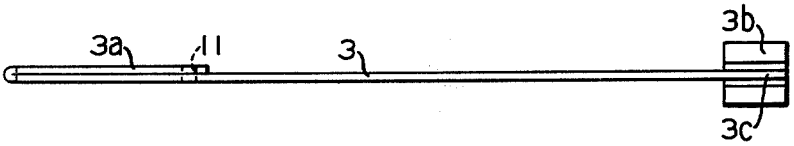
FIG. 4 is a side elevational view of the contact leaf spring element of FIG. 2 with a silver impregnated carbon block attached to the end thereof.
Figure 5:
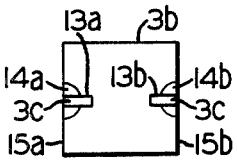
FIG. 5 is an enlarged end view of the heel contact element of FIG. 4.

It will be seen that the transfer or heel contacts include elongated beryllium copper leaf springs 3 which are substantially one-half the thickness of the elongated beryllium copper leaf springs 4 and 5 since springs 3 must be more resilient due to their movement. As shown in FIGS. 3 and 4, the terminal end 3*a* of leaf spring contact element 3 is bent back over itself to effectively double its thickness. The turned over portion increases the strength or rigidness of the plug-in terminal 3*a* and makes its thickness substantially equal to plug-in portions. 4*a* and 5*a*. A hole 11 is formed in the terminal portion 3*a* of leaf spring 3 as well as in the terminals 4*a* and 5*a* of leaf springs 4 and 5 to allow insulative material of molded block 10 to flow through and aid in anchoring the springs to the block. In viewing FIG. 3, it will be seen that the other or contact end of leaf spring 3 is bifurcated or tined at 3*c* by removing a rectangular piece of metal from the extreme end of the contact carrying portion. As shown in FIG. 4, the bifurcated end is fitted with the silver impregnated carbon contact block 3*b* which is a box-like structure having an upper flat contacting surface for engaging a front silver contact button as well as a lower flat contacting surface for engaging a back silver contact button. In viewing FIG. 5, it will be noted that the contact body 3*b* includes a rectangular slot 13*a* and 13*b*formed on the respective sides and extending along the length thereof. The elongated slots 13*a* and 13*b* are adapted to receive and accommodate the tines of the bifurcations when the silver impregnated carbon contact is slipped over the end of spring contact 3. A hollowed out or undercut 14*a* and 14*b* is made on each respective side 15*a* and 15*b* along the length of the slots 13*a* and 13*b*. The sides 15*a* and 15*b* and the cutouts 14*a* and 14*b* are preferably silver plated by electro-depositing or the like. After the silver impregnated carbon contact 3*b* is fitted onto the bifurcated ends, the tines are soldered in place by flowing solder into the cutouts 14*a* and 14*b* to make a good mechanical and electrical connection therebetween. The upper and lower contacting surfaces should be free of silver plating so that a silver impregnated carbon surface is exposed to the front and back silver contact tips 4*b* and 5*b*. That is, the silver impregnated carbon surfaces then are the contact surfaces for both the front and back contacts which as has been proven by past experience cannot become welded to the silver contact points, such as, contacts 4*b* and 5*b*. Thus, the silver impregnated carbon heel or movable contacts 3*b* ensure that neither the front contacts nor the back contacts can become welded or frozen. Accordingly, it is not necessary to employ special precautions, and there is no need to utilize ancillary structure to prevent a front contact from making or closing when a back contact freezes or welds. Hence, a unique nonweldable transfer switching assembly is realized for both the front and back contacts by constructing the heel contacts of silver impregnated carbon material for use in fail-safe electromagnetic relay.

It will be appreciated that while the present invention finds particular utility in vital electromagnetic relays, it is readily understood that the presently described movable contact switching arrangement may be employed in other electromechanical devices which require nonweldable front and/or back contacts. Further, it is understood that regardless of the manner in which the invention is used, it is apparent that various changes and modifications may be made by persons skilled in the art without departing from the spirit and scope of this invention. For example, the number of front, back and heel contacts may be varied, and the contact combinations may be changed as the situation dictates. The type and material of the front and back contacts may be selected from other shapes, sizes and conductive substances. Further, the silver impregnated contact may be plated with other suitable metals, such as, copper, chrome or the like, with equal success. The size and shape of the heel contacts, the configuration of the slots and cutouts and the leaf spring contact springs may be changed in accordance with the needs at hand. Thus, it will be evident that all variations, alterations and equivalents falling within the bounds of the present invention are herein meant to be included in the appended claims.

Having now described the invention what I claim as new and desire to secure by Letters Patent, is:

1. A movable electrical contact comprising, an elongated leaf spring member, said elongated leaf spring member having a terminal portion formed on one end and having a bifurcated portion formed on the other end, a metallic carbon contact member, said contact member having an elongated slot located on each side for accommodating said bifurcated portion, and said contact member being fused to said bifurcated portion.

2. The movable electrical contact as defined in claim 1, wherein said contact member being a cube-like piece of silver impregnated carbon material.

3. The movable electrical contact as defined in claim 1, wherein said contact member includes an upper surface for engagingly contacting a back contact.

4. The movable electrical contact as defined in claim 1, wherein said terminal portion formed on one end of said elongated leaf spring member is bent back over to form a rigid plug-in terminal.

5. The movable electrical contact as defined in claim 1, wherein said contact member includes an undercut formed on each side of said slots so that said contact member can be soldered to said bifurcated portions formed on the other end of said elongated leaf spring member.

6. The movable electrical contact as defined in claim 1, wherein an insulative actuator moves said elongated leaf spring member between two extreme positions.

7. The movable electrical contact as defined in claim 1, wherein the slotted sides of said contact member is silver plated to assist in soldering said contact member so said bifurcated portions formed on the other end of said elongated leaf spring member.

8. The movable electrical contact as defined in claim 1, wherein said terminal portion of said elongated leaf spring member is fixedly secured in a molded terminal block.

9. The movable electrical contact as defined in claim 1, wherein said contact member is a silver impregnated carbon body having a flat surface for engaging a silver point of a front contact member.

10. The movable electrical contact as defined in claim 1, wherein said contact member is a silver impregnated carbon body having a flat surface for engaging a silver point of a back contact member.

11. A fail-safe transfer switching assembly comprising, a plurality of movable heel and stationary front and back leaf spring contact members, a molded insulative contact block for retaining said leaf spring contact members in spaced relationship with each other, a plug-in terminal portion formed on one end of each of said leaf spring contact members, a silver contact button rivoted to the other end of each of said front and back leaf spring contact members, a silver impregnated carbon contact block soldered to a bifurcation formed on the other end of said movable heel leaf spring contact member for preventing welding of said silver contact buttons of said front anb back leaf spring contact members.

* * * * *